United States Patent [19]

Kakehashi

[11] 4,137,811

[45] Feb. 6, 1979

[54] ELECTRICAL STRING-INSTRUMENT

[75] Inventor: Ikutaro Kakehashi, Osaka, Japan

[73] Assignee: Roland Corporation, Osaka, Japan

[21] Appl. No.: 807,073

[22] Filed: Jun. 16, 1977

[30] Foreign Application Priority Data

Jun. 16, 1976 [JP] Japan ..... 51-71618

[51] Int. Cl.[2] ..... G10H 3/00

[52] U.S. Cl. ..... 84/1.16; 84/1.14; 84/DIG. 30

[58] Field of Search ..... 84/1.01, 1.15, 1.16, 84/DIG. 30

[56] References Cited

U.S. PATENT DOCUMENTS 3,902,395 9/1975 Avant ..... 84/DIG. 30

*Primary Examiner*—Edith S. Jackmon

*Attorney, Agent, or Firm*—Marshall & Yeasting

[57] ABSTRACT

An electrical string-instrument having a plurality of strings, a support member stretching the strings, electromechanical transducers respectively corresponding to the strings, a plurality of gate means for gating the outputs from the electromechanical transducers or signals based thereon, and gate signal generating means.

2 Claims, 5 Drawing Figures

ELECTRICAL STRING-INSTRUMENT

BACKGROUND OF THE INVENTION

1. Field of the Invention

This invention relates to an electrical string-instrument.

2. Description of the Prior Art

In recent years, the so-called electrical guitar has widely been used as an electrical string-instrument. The electrical guitar has six strings and a support member having a major surface which includes a string receiving surface and on which the strings are stretched in substantially the same plane in parallel relation to one another and in opposing relation to the string receiving surface. On the string receiving surface of the support member, a plurality of frets which extend substantially at right angles to the strings, are sequentially provided in the direction of extension of the strings. Further, in the area other than the string receiving surface in the area opposite to the strings, there are provided electromechanical transducer means for converting mechanical vibrations of the strings into corresponding electrical signals.

When playing the guitar, the player plucks a desired one or more of the strings while pressing them against the string receiving surface with his fingers or leaving the strings in the so-called open-string state. A sound signal which is obtained from the electromechanical transducer means when picking the guitar without pressing the string against the string receiving surface, is called an open-string sound signal. In the case of pressing the string against the string receiving surface with a finger, the sound signal derived from the electromechanical transducer means has a higher frequency than the abovesaid open-string sound signal. The reason is that the string is urged against the fret nearest the pressed position on the side of the electromechanical transducer means with respect to the position where the string is pressed. In the case of picking an ordinary electrical guitar, the string plucked by the finger performs a damped oscillation. Accordingly, the amplitude of the sound signal derived from the electromechanical transducer means is attenuated with the lapse of time. Therefore, the ordinary electrical guitar provides a sound signal having a damped effect but cannot produce a sound signal having a sustain effect.

Heretofore, attempts have been made to obtain the sound signal having the sustain effect with the electrical guitar. However, no satisfactory electrical guitar has been obtained for the reasons that the electrical guitar becomes bulky, and that the sound signal obtained from the electromechanical transducer means is unstable.

In the ordinary electrical guitar, the string, when twanged, performs a damped oscillation as described above, so that a sound signal having the damping effect can be obtained. In the state in which a sound signal having the damping effect is being produced by plucking a certain string, if a sound signal also having the damping effect is obtained from another string, these two sound signals respectively having the damping effect are combined with each other to provide a composite signal.

Accordingly, in the conventional electrical guitar, in the abovesaid case, the former sound signal is always provided. Consequently it is impossible with the prior art electrical guitar to obtain a sequential monophonic signal which has the damping effect and in which the two sound signals respectively having the damping effect are sequentially arranged.

Of course, in the conventional electrical guitar, in the case where a sound signal having the sustain effect is produced from one string while a sound signal having the sustain effect is being obtained from another string, it is impossible to obtain a sequential monophonic signal which has the sustain effect and in which the two sound signals are sequentially arranged.

SUMMARY OF THE INVENTION

Accordingly, an object of this invention is to provide a novel electrical string-instrument such as an electrical guitar which is simple in construction as a whole but capable of stably producing a sequential monophonic signal having the sustain effect.

Another object of this invention is to provide a novel electrical string-instrument such as a guitar which is simple in construction as a whole but capable of stably producing a sequential monophonic signal having the damping effect.

Other objects, features and advantages of this invention will become more fully apparent from the following description taken in conjunction with the accompanying drawings.

DESCRIPTION OF THE PREFERRED EMBODIMENTS

Figure 1:
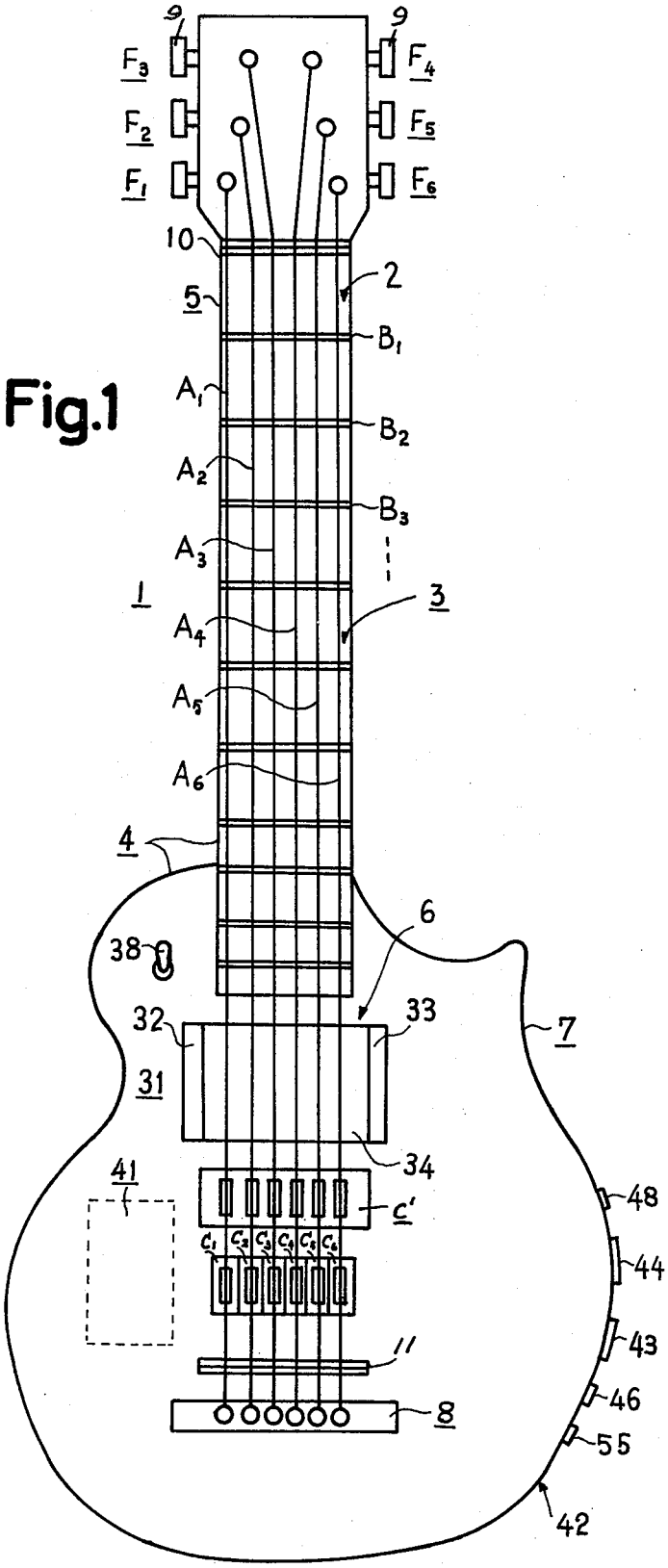
FIG. 1 is a front view schematically illustrating an embodiment of this invention as being applied to an electrical guitar.

In FIG. 1, reference numeral 1 indicates generally an example of an electrical guitar of this invention which is the electrical string-instrument proper for use in the electrical string-instrument. The electrical guitar has six conductive and magnetic strings $A_1$, $A_2$, . . . $A_6$ and a nonconductive support member 4 which has a major surface 3 including a string receiving surface 2 and on which the strings $A_1$ to $A_6$ are stretched in substantially the same plane in parallel relation to one another and in opposing relation to the string receiving surface 2.

On the string receiving surface 2 of the support member 4, a plurality of conductive frets $B_1$, $B_2$, . . . , which extend substantially at right angles to the direction of extension of the strings $A_1$ to $A_6$, are sequentially disposed in the direction of extension of the strings $A_1$ to $A_6$. That part of the support member 4 which has the string receiving surface 2 is referred to as a neck portion 5. The part which includes an area 6 of the major surface 3 of the support member 4 except the string receiving surface 2 in the area opposite to the strings $A_1$ to $A_6$, is called a body 7. The neck portion 5 extends upwardly from the body 7. At the lower side of the area 6 of the body 7, there are disposed fixing means 8, to which the strings $A_1$ to $A_6$ are fixed at one end. The other ends of the strings $A_1$ to $A_6$ are respectively retained at individual fixing means $F_1$, $F_2$, . . . $F_6$ which are provided on the upper end portion of the neck portion 6 and each have a screw 9 for adjusting the tension of each string. A little above the fixing means 8 on the area 6 of the body 7, a fret 11 is provided for bridging the strings $A_1$ to $A_6$. Disposed alightly below the fixing means $F_1$ to $F_6$ on the neck portion 5 is a fret 10 for similarly bridging the strings $A_1$ to $A_6$. The strings $A_1$ to $A_6$ are held by the frets 11 and 10, by which they are stretched to extend on the support member 4 in substantially the same plane in parallel relation to each other and in opposing relation to the string receiving surface 2.

Figure 2:
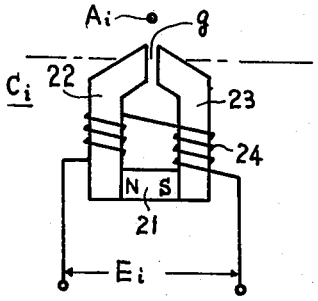
FIG. 2 is a cross-sectional view schematically showing an example of an electromechanical transducer for use in the electrical guitar depicted in FIG. 1.

At lower positions in the area 6 of the body 7, electromechanical transducer means $C_1$, $C_2$, . . . $C_6$ for converting mechanical vibrations of the strings $A_1$, $A_2$, . . . $A_6$ into corresponding electrical signals $E_1$, $E_2$, . . . $E_6$ are sequentially disposed in the direction of array of the strings $A_1$ to $A_6$ in opposing relation thereto. An example of each of the electromechanical transducer means $C_1$ to $C_6$ is such a magnetic head type one as shown in FIG. 2 which comprises a bar or plate-like magnet 22, a magnetic core 22 coupled at one end with one end of the magnet 21, another magnetic core 23 coupled at one end with the other end of the magnet 21 and having the other end disposed opposite to the other end of the magnetic core 22 to form an air gap g, and a coil 24 composed of two parts respectively wound on the cores 22 and 23. The electromechanical transducer means $C_i$ ($i = 1, 2, \ldots 6$) is disposed opposite to the string $A_i$ so that the widthwise direction of the air gap g may be substantially perpendicular to the direction of extension of the string $A_i$. Accordingly, when the string $A_i$ is vibrated by being touched at the portion opposing the surface of the area 6, a vibration voltage, which corresponds to the components of vibration in the direction perpendicular to the surface of the area 6, is obtained as an electrical sound signal $E_i$ across the coil 24 of the magnetic head type means $C_i$.

Figure 3:
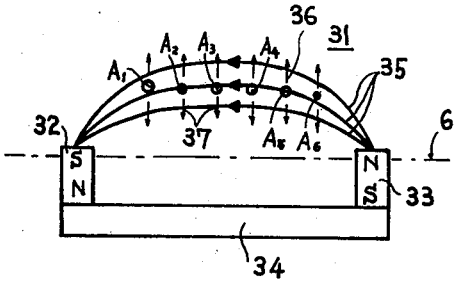
FIG. 3 is a cross-sectional view schematically showing an example of magnetic field generating means for use in the electrical guitar shown in FIG. 1.

At the upper position in the area 6 of the body 7, there is disposed magnetic field generating means 31 which sets up a constant magnetic field to cover the strings $A_1$ to $A_6$. An example of the magnetic field generating means 31 is such, for example, as depicted in FIG. 3, which comprises two bar or plate-shaped magnets 32 and 33 disposed on both sides of an area corresponding to the area of array of the strings $A_1$ to $A_6$ in their widthwise direction, and a magnetic core 34 extending between one end of the magnet 32 and one end of the magnet 33. In this case, the one end of the magnet 32 coupled with the core 34 forms the magnetic north pole and the other end the magnetic south pole. Further, the one end of the magnet 33 coupled with the core 34 forms the magnetic south pole and the other end the magnetic north pole. Accordingly, at the upper position in the area 6 of the body 7, there is generated a magnetic field 35 emanating from the magnetic north pole of the magnet 33 to the magnetic south pole of the magnet 32 in a direction perpendicular to the direction of extension of the strings $A_1$ to $A_6$ to cross them. Therefore, if a current flows in the string $A_i$, the string $A_i$ is moved by the Flemings law in the direction perpendicular to the area 6 in accordance with the direction of the current flowing in the string $A_i$, as indicated by the arrows 36 and 37.

Figure 4:
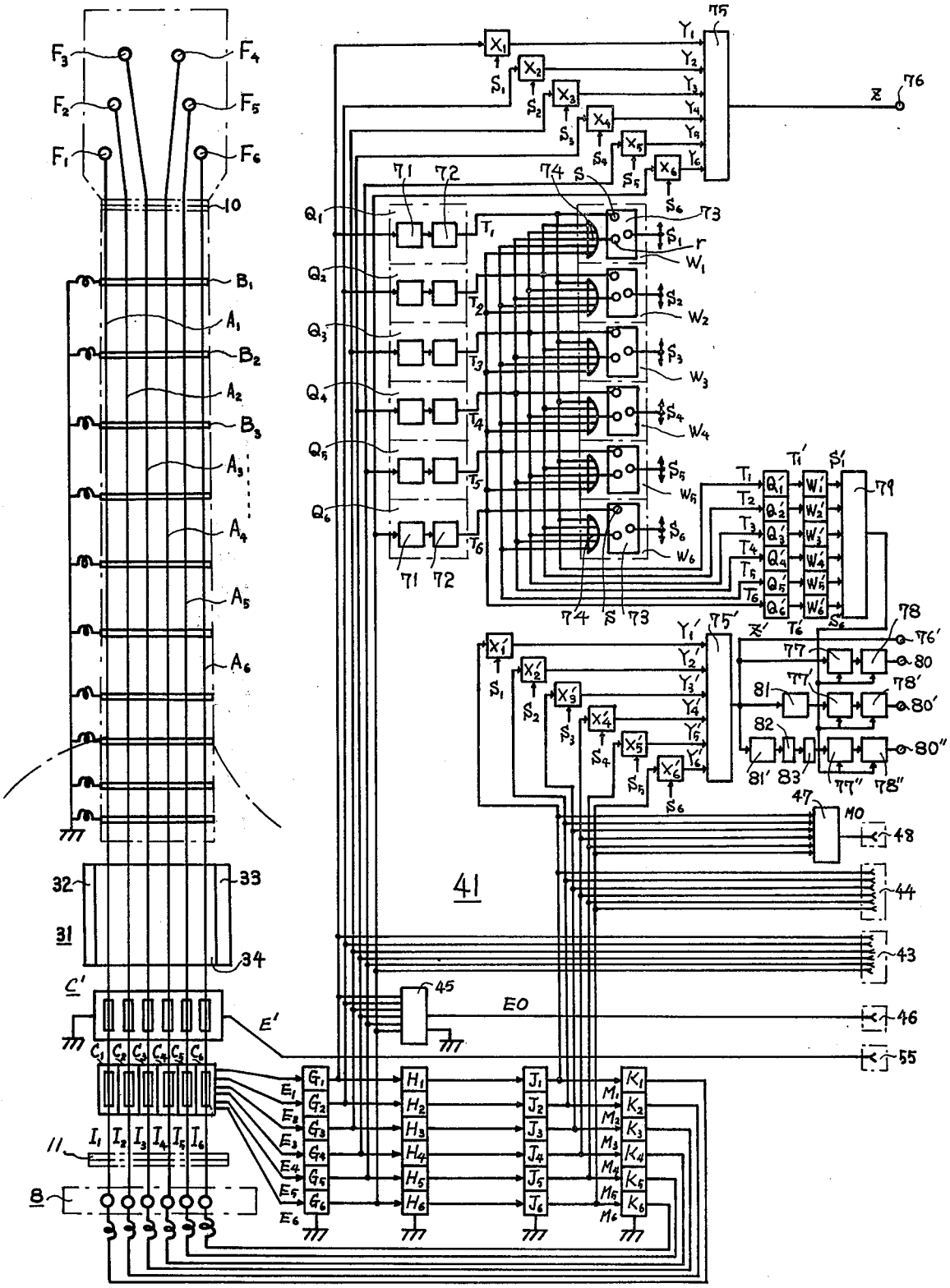
FIG. 4 is a schematic diagram illustrating an example of the electrical construction of the electrical string-instrument shown in FIG. 1.

The body 7 has disposed therein an electrical circuit 41 indicated by the broken-line block in FIG. 1. In the electrical circuit 41, as shown in FIG. 4, the electrical sound signals $E_1$, $E_2$, . . . $E_6$ respectively derived from the coils 24 of the electromechanical transducer means $C_1$, $C_2$, . . . $C_6$ are amplified by preamplifiers $G_1$, $G_2$, . . . $G_6$, and then supplied to threshold circuits $J_1$, $J_2$, . . . $J_6$ through ganged switches $H_1$, $H_2$, . . . $H_6$, respectively, by which signals, shaped into rectangular waveforms which are "1" or "0" in the binary representation depending upon whether the electrical sound signals $E_1$, $E_2$, . . . $E_6$ are above or below predetermined levels, respectively, are obtained as feedback signals $M_1$, $M_2$, . . . $M_6$. Then, the signals $M_1$, $M_2$, . . . $M_6$ thus obtained are amplified by driving amplifiers $K_1$, $K_2$, . . . $K_6$, respectively. An actuator 38 for the ganged switches $H_1$ to $H_6$ is provided on the major surface 3 in the area on the body 7.

The outputs of the driving amplifiers $K_1$, $K_2$, . . . $K_6$ of the electrical circuit 41 are respectively connected at one end to the ends of the strings $A_1$, $A_2$, . . . $A_6$ on the side of the fixing means 9, and grounded at the other end. Also, the abovesaid conductive frets $B_1$, $B_2$, . . . are grounded. Accordingly, when the string $A_i$ is plucked by one finger at the position opposite to the area 6 while being urged by another finger against the string receiving surface 2 and engaged with the fret $B_j$ ($j = 1, 2, \ldots$), a feedback current $I_i$ based on the amplified feedback signal $M_i$ derived from the driving amplifier $K_i$ flows in the string $A_i$ as long as the string $A_i$ is pressed against the string receiving surface 2 and engaged with the fret $B_j$. Consequently, if the polarity of the feedback signal $M_i$ is selected such that the string $A_i$ may be moved by the Fleming's law in the same direction as the direction of vibration of the string $A_i$ when plucked, when the string $A_i$ has once been twanged by a finger while being urged against the string receiving surface 2 and engaged with the fret $B_j$, the string $A_i$ continues to vibrate as long as it is pressed against the string receiving surface 2 and engaged with the fret $B_j$. Accordingly, the sound signal $E_i$ from the electromechanical transducer $C_i$ or preamplifier $G_i$ is obtained as a sound signal corresponding to the continuous vibration of the string $A_i$. Such a signal is called a sound signal having the sustain effect. Further, when released from the abovesaid pressed state, the string $A_i$ immediately starts to perform a damped vibration. As a result of this, the sound signal $E_i$ from the electromechanical transducer $C_i$ or preamplifier $G_i$ is obtained as a damped sound signal. The sound signals $E_1$ to $E_6$ derived from the preamplifiers $G_1$ to $G_6$ are led out as one kind of output from the electrical circuit 41 to the outside through a multi-jack 43 disposed on the side 42 of the body 7. Further, the sound signals $M_1$ to $M_6$ having rectangular waveforms, derived from the threshold circuits $J_1$ to $J_6$, are similarly led out as another kind of output from the electrical circuit 41 to the outside through a multi-jack 44 disposed on the side 42 of the body 7.

Further, the electrical circuit 41 is designed so that the amplified electrical sound signals $E_1$ to $E_6$ from the preamplifiers $G_1$ to $G_6$ are mixed by the mixing circuit 45 to derive therefrom a signal EO into which the electrical signals $E_1$ to $E_6$ are combined. The electrical signal EO thus obtained from the mixing circuit 45 is led out as another kind of output from the electrical circuit 41 to the outside through a jack 46 provided on the side 42 of the body 7. Accordingly, if the electrical guitar of this invention is played in the state in which the abovesaid switches $H_1$ to $H_6$ are held in the off state by the aforementioned actuator 38, the feedback signals $M_1$ to $M_5$ are not derived from the threshold circuits $J_1$ to $J_6$, so that the currents $I_1$ to $I_6$ do not flow in the strings $A_1$ to $A_6$. As a result of this, the electrical sound signals $E_1$ to $E_6$ from the electromechanical transducer means $C_1$ to $C_6$ are not the sound signals corresponding to the abovesaid continuous vibration of the string, so that the signal EO led out to the outside through the jack 46 is obtained as a sound signal of the same mode as a sound signal obtained with an ordinary electrical guitar. However, when the electrical guitar of this invention is played with all or some of the strings $A_1$ to $A_6$ urged by fingers against the string receiving surface 2 in the state in which the switches $H_1$ to $H_6$ are held in the on state by the actuator 38,, electrical sound signals derived from all or some of the electromechanical transducer means $C_1$ to $C_6$ corresponding to the strings pressed against the string receiving surface 2 in this case are obtained as sound signals corresponding to the aforesaid continuous vibration, so that the signal EO led out to the outside through the jack 46 is a sound signal having the sustain effect. Further, the electrical circuit 41 has a mixer 47 which is adapted such that the signals $M_1$ to $M_6$ of the rectangular waveform, derived from the threshold circuits $J_1$ to $J_6$ are mixed together to provide a composite signal MO. The signal MO thus obtained from the mixer 47 is led out as another kind of output from the electrical circuit 41 to the outside through a jack 48. Accordingly, when the guitar is played in the state that the switches $H_1$ to $H_6$ are closed by the operation of the actuator 38, the sound signal MO of rectantular waveform having the sustain effect is led out to the outside.

Though not shown in FIG. 1, there are provided separately of the electrical guitar proper 1 timing signal generators $Q_1, Q_2, \ldots Q_6$ which are respectively supplied with the sound signals $E_1, E_2, \ldots Ee_6$ from the preamplifiers $G_1, G_2, \ldots E_6$ to provide timing signals $T_1, T_2, \ldots T_6$, as illustrated in FIG. 4. The sound signal $E_i$, which is derived from the preamplifier $G_i$ when the string $A_i$ is plucked, with the switches $H_1$ to $H_6$ of the abovesaid electrical circuit 41 held in the off state, is generally obtained as a vibratory wave which performs a damped vibration from the moment of plucking the string $A_i$. However, when the string $A_i$ is twanged with the switches held in the off state, the sound signal $E_i$ derived from the preamplifier $G_i$ is obtained as a vibratory wave whose level is higher than that of the time of plucking the string $A_i$ and remains constant. The timing signal generator circuit $Q_i$ is comprised of an envelope detector 71 for detecting the envelope of the sound signal $E_i$ composed of such a vibratory wave and an amplifier 72 for amplifying with saturation the envelope detecting output from the envelope detector 71 to obtain a rectangular wave. Accordingly, the timing signal $T_i$ is obtained as a rectangular wave derived from such an amplifier 72. The leading edge of such a timing signal $T_i$ is indicative of the moment when the string $A_i$ has been plucked.

Further, there are provided separately of the electrical guitar proper 1 gate signal generators $W_1, W_2, \ldots W_6$ which are respectively supplied with the timing signals $T_1$ to $T_6$ to provide gate signals $S_1, S_2, \ldots S_6$, as shown in FIG. 4. The gate signal generator $W_i$ is composed of a flip-flop 73 having a set terminal S which is set by the leading edge of the timing signal $T_i$, and an OR circuit 74 whose output end is connected to a reset terminal r of the flip-flop 73. The OR circuit 74 of the gate signal generator $W_1$ is supplied with the timing signals $T_2$ to $T_6$ except $T_1$; the OR circuit 74 of the circuit $W_2$ is supplied with the signals $T_1$ and $T_3$ to $T_6$ except $T_2$; the OR circuit 74 of the circuit $W_2$ is supplied with the signals $T_1$, $T_2$, and $T_4$ to $T_6$ except $T_3$; the OR circuit 74 of the circuit $W_4$ is supplied with the signals $T_1$ to $T_3$, $T_5$ and $T_6$; the OR circuit 74 of the circuit $W_5$ is supplied with the signals $T_1$ to $T_4$ and $T_6$; and the OR circuit 74 of the circuit $W_6$ is supplied with the signals $T_1$ to $T_5$. Accordingly, if the timing signal, for instance, $T_2$ is obtained after the timing signal $T_1$ is produced, a rectangular output, which presents a value "1" in the binary representation from the moment of the leading edge of the signal $T_1$ to the moment of the leading edge of the signal $T_3$, is obtained as the gate signal $S_1$. Generally, when one (hereinafter identified by $T_p$) of the timing signals $T_1$ to $T_6$ except $T_i$ is provided after the timing signal $T_i$, a rectangular output which presents the value "1" in the binary representation from the moment of the leading edge of the signal $T_i$ to the moment of the leading edge of the abovesaid one timing signal $T_p$ is derived as the gate signal $S_i$ from the flip-flop 73 of the circuit $W_i$.

Moreover, there are provided separately of the electrical guitar proper 1 gate circuits $X_1, X_2, \ldots X_6$ which are respectively supplied with the sound signals $E_1, E_2, \ldots E_6$ from the preamplifiers $G_1, G_2, \ldots G_6$ of the abovesaid electrical circuit 41. On the other hand, outputs $Y_1, Y_2, \ldots Y_6$ from the gate circuits $X_1, X_2, \ldots X_6$ that the sound signals $E_1, E_2, \ldots E_6$ are gated, are supplied to a mixer 75, from which is derived at its output terminals 76 a composite signal Z that the outputs $Y_1$ to $Y_6$ are combined with one another. In this case, the gate circuit $X_i$ is adapted to gate the signal $E_i$ with the gate signal $S_i$ derived from the gate signal generator $W_i$.

Accordingly, for example, if the string $A_3$ is plucked after the string $A_1$, the electrical sound signal $E_1$ is obtained from the preamplifier $G_1$ and then the sound signal $E_3$ is derived from the preamplifier $G_3$. When such sound signals $E_1$ and $E_3$ have once been obtained, the timing signal $T_1$ is derived from the timing signal generator $Q_1$ and then the timing signal $T_3$ is derived from the timing signal generator $Q_3$. Further, the gate signal $S_1$ is obtained from the gate signal generator $W_1$ and then the gate signal $S_3$ is derived from the gate signal generator $W_3$. Consequently, the output $Y_1$ that the signal $E_1$ is gated by the gate signal $S_1$ is derived from the gate circuit $X_1$ and then the output $Y_3$ that the signal $E_3$ is gated by the gate signal $S_3$ is derived from the gate circuit $X_3$. As a result of this, the output Z which is derived at the output terminal 76 of the mixer 75 is obtained as a sequential monophonic signal in which the output $Y_1$ resulting from gating of the signal $E_1$ with the gate signal $S_1$ and the output $Y_3$ resulting from gating of the signal $E_3$ with the gate signal $S_3$. Further, after the string $A_i$ is plucked, if one of the strings $A_1$ to $A_6$ except the string $A_i$ (hereinafter identified by $A_p$) is twanged, the output Z derived at the output terminal 76 is obtained in the form of such a sequential monophonic signal that the output $Y_i$ produced by gating the signal $E_i$ with the gate signal $S_i$ and the output $Y_p$ produced by gating the signal $E_p$ with the gate signal $Y_p$ are sequentially arranged, the signal $E_p$ being derived from the preamplifier $G_p$ corresponding to the string $A_p$ and the gate signal $Y_p$ being obtained from the gate signal generator $X_p$ similarly corresponding to the string $A_p$.

When the switches $H_1$ to $H_6$ of the abovesaid electrical circuit 41 are in the on state, the sound signal $E_i$ from the preamplifier $G_i$ has the sustain effect as described above, so that the output z, obtained as such a monophonic signal, is produced as a sequential monophonic signal having the sustain effect. Further, when the switches $H_1$ to $H_6$ of the electrical circuit 41 are in the off state, the sound signal $E_i$ from the preamplifier $G_i$ has the damping effect as described above, so that the output Z derived from the sequential monophonic signal is obtained as a sequential monophonic signal having the damping effect.

The foregoing description has been given of the case where the sequential monophonic signal having the sustain effect and the sequential monophonic signal having the damping effect are both such signals based on the sound signals $E_1$ to $E_6$ obtained from the preamplifiers $G_1$ to $G_6$ of the electrical circuit 41. However, it is also possible that the rectangular, sequential monophonic signal having the sustain effect is obtained based on the rectangular sound signals $M_1$ to $M_6$ derived from the threshold circuits $J_1$ to $J_6$ of the electrical circuit 41. In this case, as illustrated in FIG. 4, gate circuits $X_1'$, $X_2'$, . . . $X_6'$ which are respectively supplied with the signals $M_1$ to $M_6$ respectively derived from the threshold circuits $J_1$ to $J_2$, are provided separately of the electrical guitar proper 1, and these gate circuits are respectively controlled by the gate signals $S_1$, $S_2$, . . . $S_6$ derived from the gate signal generators $W_1$, $W_2$, . . . $W_6$. Further, outputs $Y_1'$, $Y_2'$, . . . $Y_6'$, produced by gating the signals $M_1$, $M_2$, . . . $M_6$ from the gate circuits $X_1'$, $X_2'$, . . . $X_6'$ with the gate signals $S_1$, $S_2$, . . . $S_6$, are supplied to a mixer 75'. It will be evident that in such a case, there is derived at the output terminal 76' of the mixer 75' an output Z' which is composed of a sequential monophonic signal having the sustain effect based on the sound signals $M_1$ and $M_6$, though not described in detail.

Further, it is also possible to perform the following operation:- The output Z' derived from the mixer 75', composed of the sequential monophonic signal having the sustain effect, is supplied to a voltage-controlled type filter 77 whose frequency characteristic is modulated by a voltage control, and the output therefrom is supplied to a voltage-controlled type amplifier 78 whose amplification degree is similarly modulated by a voltage control. On the other hand, the timing signals $T_1$ to $T_6$ from the aforesaid timing signal generators $Q_1$ to $Q_6$ are applied to trigger pulse generators $Q_1'$ to $Q_6'$ to provide trigger pulses $T_1'$ to $T_6'$ at the moments of the leading edges of the respective timing signals. The trigger pulses $T_1'$ to $T_6'$ thus obtained are respectively applied to envelope voltage generators $W_1'$ to $W_6'$ to produce envelope voltages $S_1'$ to $S_6'$ of desired waveforms from the moments of generation of the trigger pulses $T_1'$ to $T_6'$. These envelope voltages $S_1'$ to $S_6'$ are combined by a mixer 79, the composite output from which is supplied as a control voltage to the aforementioned voltage-controlled type filter 77 and voltage-controlled type amplifier 78, thereby to derive at the output terminal 80 of the voltage-controlled type amplifier 78 an output of the mode that the frequency characteristic and amplitude of the output Z' have been modulated by the composite output of the envelope voltages $S_1'$ to $S_6'$.

Also, the following operation is possible. The output Z' from the mixer 75', composed of the sequential monophonic signal having the sustain effect, is supplied to a known fundamental wave extractor 81, the output from which is supplied to a cascade-connected circuit of a filter 77' and an amplifier 78' respectively similar to the voltage-controlled type filter 77 and the voltage-controlled type amplifier 78 described above. The abovesaid filter 77' and amplifier 78' are controlled by the composite output of the envelope voltages $S_1'$ to $S_6'$, derived from a mixer 79, whereby to provide at an output terminal 80' of the amplifier 78' an output of the mode that the frequency characteristic and amplitude of the fundamental wave component of the output Z' are modulated by the composite output of the envelope voltages $S_1'$ to $S_6'$.

Also, it is possible to effect the following operation:- The output Z' from the mixer 75' is supplied to a fundamental wave extractor 81', the outut from which is, in turn, applied to a frequency-voltage converter 82. Then, the output from the converter 82 is supplied to a voltage variable type oscillator 83 and its oscillation output is applied to a cascadeconnected circuit of a filter 77'' and an amplifier 78'' which are similar to the abovesaid voltage-controlled filter 77 and amplifier 78. The filter 77'' and the amplifier 78'' are controlled by the composite output of the envelope voltages $S_1'$ to $S_6'$ which is derived from the mixer 79, thereby to obtain from the oscillator 83 a fundamental wave output of a desired frequency corresponding to the fundamental wave component of the output Z', or a composite output composed of the abovesaid fundamental wave output and its harmonic wave component. Thus, there is derived from the output terminal 80'' of the amplifier 78'' an output of the mode that the frequency characteristic and amplitude of the output from the oscillator 83 is modulated by the composite output of the envelope voltages $S_1'$ to $S_6'$.

Figure 5:
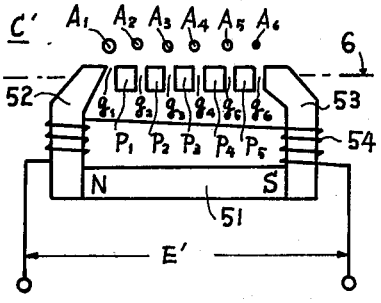
FIG. 5 is a schematic cross-sectional view illustrating an example of a common electromechanical transducer for use in the electrical guitar depicted in FIG. 1.

The foregoing description has been given of the case where only the electromechanical transducer means $C_1$, $C_2$, . . . $C_6$ are disposed on the area 6 of the electrical guitar proper 1 in opposing relation to the strings $A_1$, $A_2$, . . . $A_6$, respectively. However, it is possible to dispose opposite to the strings $A_1$ to $A_6$ at the center of the area 6 electromechanical transducer means C' which converts mechanical vibrations of the strings $A_1$ to $A_6$ into a composite signal E' of electrical signals corresponding to the vibrations and which is common to the strings $A_1$ to $A_6$, as shown in FIG. 1. The electromechanical transducer means C' is, for instance, such a multigap magnetic head type one as shown in FIG. 5, which is composed of a bar or plate-like magnet 51, a magnetic core 52 coupled at one end with one end of the magnet 51, a magnetic core 52 coupled at one end with the other end of the magnet 51 and having the other end disposed opposite to the other end of the magnetic core 52, mangetic core elements $P_1$, $P_2$, . . . $P_5$ disposed between the other ends of the magnetic cores 52 and 53 to form air gaps $g_1$, $g_2$, . . . $g_6$, and a coil 54 composed of two parts respectively wound on the magnetic cores 52 and 53. The electromechanical transducer means C' is disposed opposite to the strings $A_1$, $A_2$, . . . $A_6$ so that the widthwise directions of the gaps $g_1$, $g_2$, . . . $g_6$ may be substantially perpendicular to the direction of extension of the strings $A_1$, $A_2$, . . . $A_6$. Accordingly, when the string $A_i$ is plucked to vibrate, a vibration voltage which corresponds to the components of vibration in the direction perpendicular to the surface of the area 6 is obtained as the electrical sound signal E' across the coil 54 of the magnetic head type means C'. Further, when some or all of the strings $A_1$ to $A_6$ are simultaneously twanged to vibrate, a voltage that vibration voltages corresponding to the components of the vibrations in the direction perpendicular to the surface of the area 6 are superimposed one on another is obtained as the electrical sound signal E'. The sound signal E' thus derived from the electromechanical transducer means C' is led out to the outside through a jack 55 mounted on the side 42 of the body 7, as is more apparent from FIGS. 1 and 4.

In the foregoing, magnetic head type transducers are used as the electromechanical transducer means, but may also be electrostatic head type. In such a case, the strings need not be magnetic. Moreover, the foregoing has described the embodiments of the present invention as applied to the electrical guitar but it should be understood that the invention is also applicable to electrical string-instruments similar to the electrical guitar.

It will be apparent that many modifications and variations may be effected without departing from the scope of novel concepts of this invention.

I claim as my invention:

1. An electrical string-instrument comprising:

N strings $A_1, A_2, \ldots A_N$;

a support member having a major surface including a string receiving surface and stretching the strings $A_1$ to $A_N$ in opposing relation thereto to extend in substantially the same plane in parallel relation to one another;

a plurality of frets disposed on the string receiving surface, which frets are sequentially disposed in the direction of extension of the strings $A_1$ to $A_N$ to extend in the direction perpendicular thereto;

electromechanical transducer means $C_1, C_2, \ldots C_N$ disposed in the area other than the string receiving area in the area opposite to the strings $A_1$ to $A_N$ on the major surface of the support member for converting mechanical vibrations of the strings $A_1, A_2, \ldots A_N$ into corresponding electrical signals $E_1, E_2, \ldots E_N$, respectively;

means by which, based on the electrical signals $E_1, E_2, \ldots E_N$, in the case where the electrical signal $E_i (i = 1, 2, \ldots N)$ is obtained and then one (hereinafter identified by $E_p$) of the electrical signals $E_1$ to $E_N$ except $E_i$ is obtained, a gate signal $S_i$ is produced which has a value "1" in the binary representation from the moment of generation of the electrical signal $E_i$ to the moment of generation of the electrical signal $E_p$; and N gate means $X_1, X_2, \ldots X_N$ for gating N signals based on the electrical signals $E_1, E_2, \ldots E_N$ derived from the electromechanical transducer means $C_1, C_2, \ldots C_N$ under the control of the electrical signals $S_1, S_2, \ldots S_N$, respectively.

2. An electrical string-instrument according to claim 1, wherein the strings $A_1$ to $A_N$ are conductive, and which further includes magnetic field generating means disposed in the area other than the string receiving area in the area opposite to the strings $A_1$ to $A_N$ on the major surface of the support member for generating a constant magnetic field to cover therewith the strings $A_1$ to $A_N$, an electrical circuit for producing feedback signals $M_1, M_2, \ldots M_N$ based on the electrical signals $E_1$ to $E_N$, and feedback signal supply means for supplying the feedback signals $M_1$ to $M_N$ to flow feedback currents $I_1, I_2, \ldots I_N$ in those of the strings $A_1$ to $A_N$ placed in he constant magnetic field emanating from the magnetic field generating means.

* * * * *